United States Patent [19]

Roncaglione

[11] 4,288,996

[45] Sep. 15, 1981

[54] PORTABLE SUBLIMATION REFRIGERATOR-FREEZER

[76] Inventor: Walter Roncaglione, 2881 NE. 35th Ct., Fort Lauderdale, Fla. 33308

[21] Appl. No.: 97,999

[22] Filed: Nov. 28, 1979

Related U.S. Application Data

[63] Continuation-in-part of Ser. No. 946,496, Oct. 18, 1978, Pat. No. 4,195,491.

[51] Int. Cl.[3] ..... F25D 3/12

[52] U.S. Cl. ..... 62/384; 62/125; 62/457; 73/40; 137/67; 251/122

[58] Field of Search ..... 62/125, 384, 388, 457, 62/459, 464; 73/40; 251/122; 137/67

[56] References Cited

U.S. PATENT DOCUMENTS

| | | | |
|---|---|---|---|
| 1,959,863 | 5/1934 | Griss | 73/40 |
| 2,610,472 | 9/1952 | Maxwell | 62/384 |
| 3,820,355 | 6/1974 | Olivares | 62/384 |
| 3,855,816 | 12/1974 | Miller | 62/457 |
| 3,959,982 | 6/1976 | Denis et al. | 62/457 |

*Primary Examiner*—Ronald C. Capossela
*Attorney, Agent, or Firm*—Krass & Young

[57] ABSTRACT

A sublimation refrigerator employs a thermally insulated outer housing having a pivotable top. A smaller insulated dry ice chamber is adapted to be supported centrally within the container as is a separate insulated freezer compartment having a removable top. A first set of serpentine cooling coils are supported in the interior side walls of the main insulated container and in the side walls of the freezer compartment. One end of each of these coils connects to the dry ice chamber. A bubble type visual flow indicator having a transparent window is supported on the exterior of the main container. The output ends of both the freezer coil and the cooler coil connect to the visual indicator through manually adjustable flow control valves. The output of the visual indicator vents to atmosphere. In normal use the valve at the output of the freezer coil is opened allowing free flow of gas sublimating from the dry ice through the freezer coil so that a very low temperature is attained within the freezer. The valve at the output of the cooler coil is then used to control the flow to attain a desired cooler temperature and the freezer valve may be temporarily closed allowing the visual indicator to be used for adjustment of the cooler coil. Since both freezer and cooler coils are fed simultaneously control of each area is by the valves, and closing either one will allow all gases to go through a desired area.

12 Claims, 8 Drawing Figures

PORTABLE SUBLIMATION REFRIGERATOR-FREEZER

REFERENCE TO RELATED APPLICATIONS

This application is a continuation-in-part of application Ser. No. 946,496, filed Oct. 18, 1978 entitled "Dry Ice Refrigerator" now U.S. Pat. No. 4,195,491.

BACKGROUND OF THE INVENTION

1. Field of the Invention

This invention relates to a portable cooler having a lower temperature freezer compartment that attains its cooling by the flow of gases derived from the sublimation of dry ice or the like.

2. Prior Art

A variety of refrigerators have been proposed which depend upon the circulation of gases derived from the sublimation of a frozen solid, such as dry ice, for their cooling effect. My copending patent application Ser. No. 946,496 now U.S. Pat. No. 4,195,491 discloses a portable cooler employing the sublimation principle. That cooler employes an insulated outer body of the type used with portable ice chests, having an open top and either a pivotable or removable insulated cover. A smaller chamber for dry ice or other sublimating solid is removably supported centrally within the cooler. A flexible conduit connects the interior of the dry ice chamber to a pair of serpentine cooling coils supported in the opposed upright sides of the cooler chamber. The two coils are connected in parallel and their output is vented to the atmosphere, exteriorly of the cooler, through a manually adjustable flow control valve and a visual flow indicator consisting of a liquid chamber having a transparent window. The bubbles visible through the window provide an indication of the flow rate through the coil and allow adjustment of the temperature in the cooler.

A relatively small quantity of dry ice will allow the maintenance of a conventional refrigeration temperature of about 40° in the cooler box for several days. The dry ice chamber may be removed so that the outer container may be used as a conventional ice box.

The single relatively uniform temperature that is attained throughout this cooler prevents its use for the simultaneous storage of items that must be kept frozen such as frozen foods, ice cream and the like, and other items which must be refrigerated but would be harmed if they were frozen, such as fresh produce and drinks.

SUMMARY OF THE INVENTION

The present invention is directed toward a modified form of sublimation refrigerator including a freezer volume adapted to be maintained at a low temperature, such as 10° to 20° F. and a separate cooler volume which can be supplied from the same sublimation source yet will attain a higher refrigeration temperature such as 35° to 45° F. The preferred embodiment of my invention includes means for adjusting the temperature of both the cooler and freezer sections of the box and for providing a visual indication of gas flow through the cooler and/or the freezer section.

In addition to the dry ice container and cooler coils used with my previous invention, the unit of the present invention provides a separate freezer compartment with a removable top, formed within the cooler. A separate refrigerant coil services the freezer and has one end connected to the interior of the dry ice compartment by a flexible conduit. The outlet of the freezer coil vents to the atmosphere through a manually adjustable flow valve and a bubble type visual flow indicator. The output of the cooler section coils also passes through the flow indicator and this flow may be controlled by a second manually adjustable flow control valve positioned on the exterior of the cooler.

In normal use the valve on the freezer coil output is opened and the bubble passage through the liquid chamber provides a visual indication of flow from both the freezer and cooler coils. When it is desired to adjust the temperature in the cooler section the freezer valve may be briefly closed so that the bubble chamber provides a visual indication of the flow through the cooler line only. The flow control valve at the output of the cooler line may then be adjusted, increasing or decreasing the flow to achieve lower or warmer temperatures respectively within the cooling chamber. The freezer valve is then opened so that the bubble chamber provides a continuous indication of the proper operation of the system. Alternatively, when food preserving temperatures are attained in the cooler, the flow of gases through the cooler may be shut off allowing the flow of gases through the freezer alone and the freezer will act to retain the entire unit at proper food preserving temperatures.

Other objectives, advantages and applications of the present invention will be made apparent by the following detailed description of a preferred embodiment of the invention. The description makes reference to the accompanying drawings in which.

Figure 2:
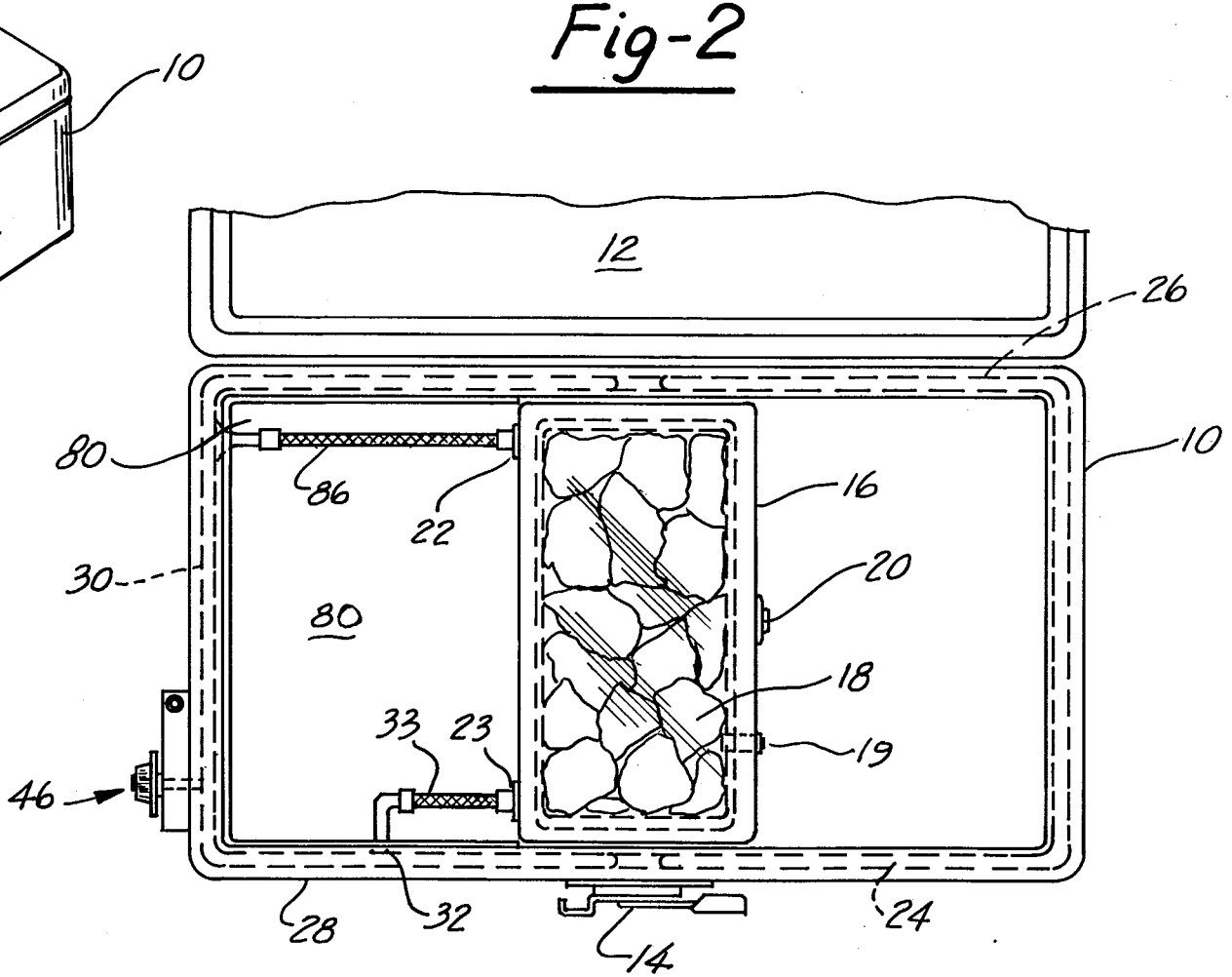
FIG. 2 is a top view of the preferred embodiment of the cooler with the top opened and the freezer top removed.
Figure 1:
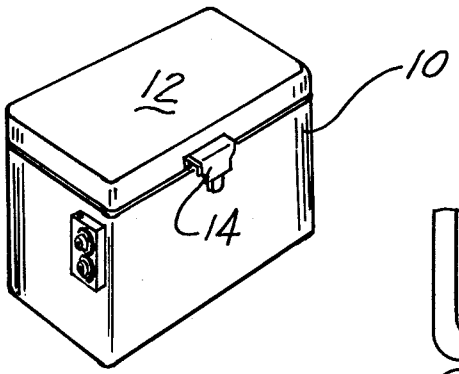
FIG. 1 is a perspective view of the exterior of a cooler forming a preferred embodiment of my invention.

The invention employs a conventional insulated cooler 10 of the type sold for picnic coolers and the like. These coolers are generally rectangular with a hinged top 12. A latch 14 allows the top to be closed so as to seal the contents of the cooler from the atmosphere.

The preferred embodiment of the cooler is rectangular and the refrigeration apparatus, subsequently described, is adapted for incorporation in such a rectangular container, but alternative embodiments of the invention could employ other shapes, such as cylindrical coolers, and other components of the invention could be formed for use with these units.

The cooler 10 may be of the present commercially available variety but the preferred embodiment specially formed for use with the refrigeration system of the present invention.

The refrigeration system employs a dry-ice container 16 taking the form of a rectangular box with an open top, the box having walls formed of a material with excellent insulation properties, such as foamed plastic or the like. The dimensions of the container 16 are much smaller than the dimensions of the cooler 10 with the container disposed within the cooler and only occupying a small percentage of its volume. The container 16 preferably has a length complementary to the interior width of the cooler 10 so that it may be supported between the interior sidewalls of the cooler. The container 6 is supported centrally along the longitudinal axis of the cooler so its end walls are spaced from the end walls of the cooler.

The dry ice container 16 has a hinged lid 18 which may be secured by a latch 20. The lid 18 may be opened to allow insertion of dry ice or some other form of frozen, sublimating material into the interior of the container. The lid 18 is then secured with a latch 20 sealing the container 16 except for gas outlets 22 and 23 formed through the side of the container.

A resilient blow-out plug 19 is inserted into a complementary aperture in the wall of the container 16 to prevent the build-up of high gas pressures in the container in the event of blockage of the cooling coils.

The refrigeration assembly includes a pair of serpentine cooling coils 24 and 26 disposed within the opposed side walls of the container 10.

The input end 28 of coil 24 and input end 30 of coil 26 extend normally to the side walls, toward one another and are joined to an input connector 32. A flexible conduit 33 joins the input connector to the gas outlet 23 of the dry ice container so that gas formed by sublimation of dry ice disposed within the container 16 may pass outwardly through conduit 33 into both of the cooling coils 24 and 26.

The output ends 34 and 36 of the cooling coils 24 and 26 extend normally to the side walls at the end of the coils opposite to the input ends 28 and 30. The output ends 34 and 36 of the two coils are both joined to a central output connection 38. By means of the connectors 32 and 38, the two coils 24 and 26 are essentially connected in parallel. In alternative embodiments of the invention, only a single continuous coil might be employed or other coil sections might be connected in parallel. The coil sections might be disposed in the bottom or end side walls of the container as well as, or instead of, the two side walls served by the cooling coils 24 and 26. In alternative embodiments, the cooling coils could be built removable from the walls of the insulated cooler rather than being built into the walls of the cooler.

The output connector 38 has connections through the cooler wall to a manually adjustable output valve 46 supported on the exterior end wall of the cooler. Gas from the cooling coils may be passed through the valve 46, through an associated visual indicator 48, and vented to the atmosphere from the indicator.

Figure 3:
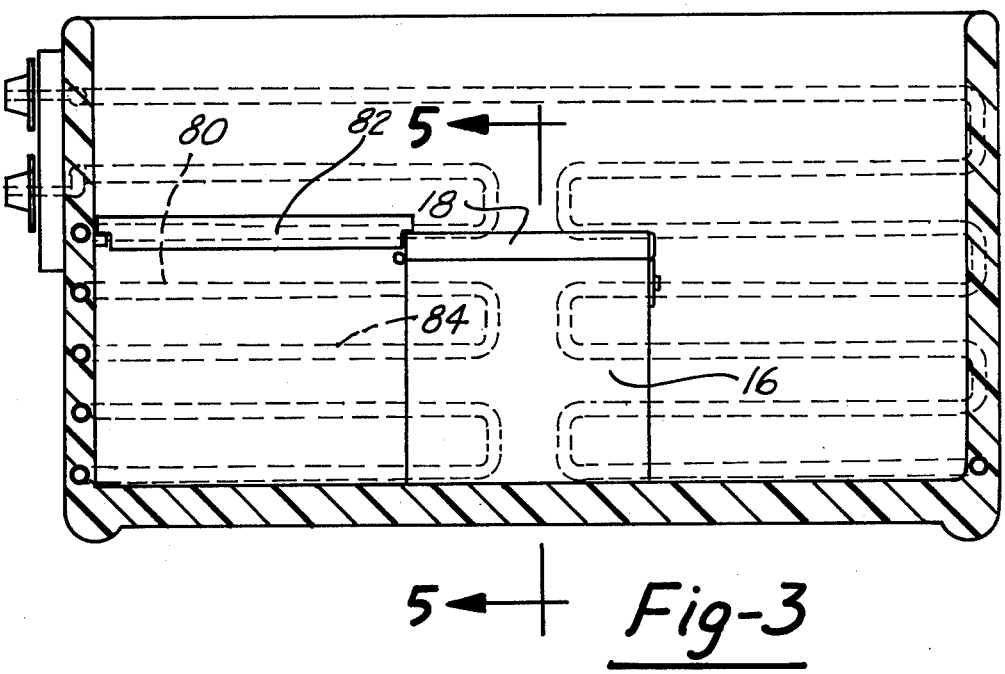
FIG. 3 is a longitudinal sectional view through the cooler.
Figure 4:
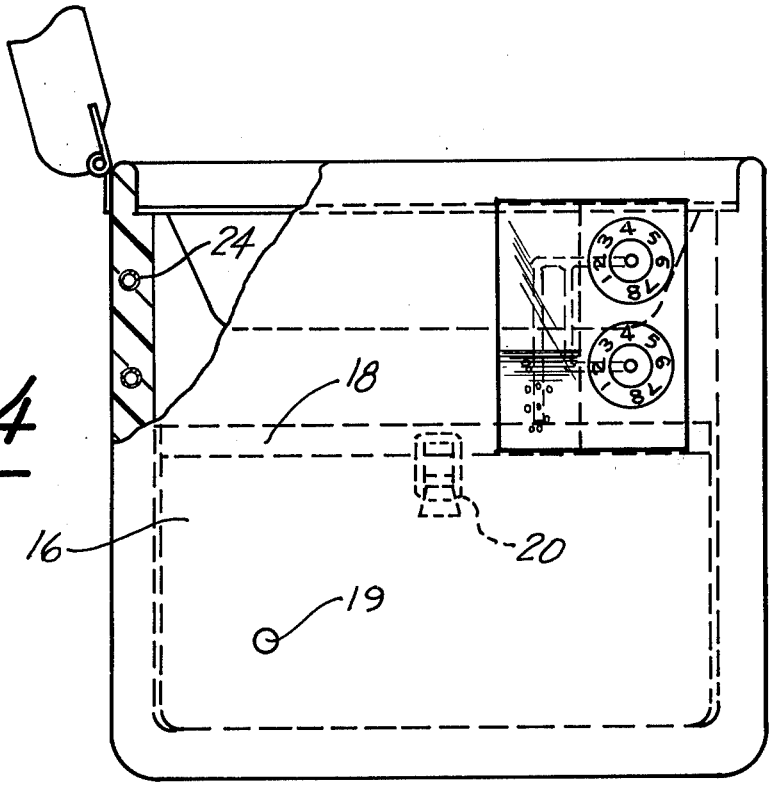
FIG. 4 is an end view of the preferred embodiment of my cooler partially broken away for purposes of illustration.
Figure 5:
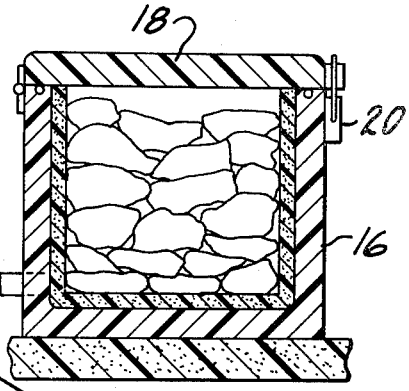
FIG. 5 is a transverse sectional view through the dry ice container of the preferred embodiment of my invention, taken along line 5—5 of FIG. 3.
Figure 6:
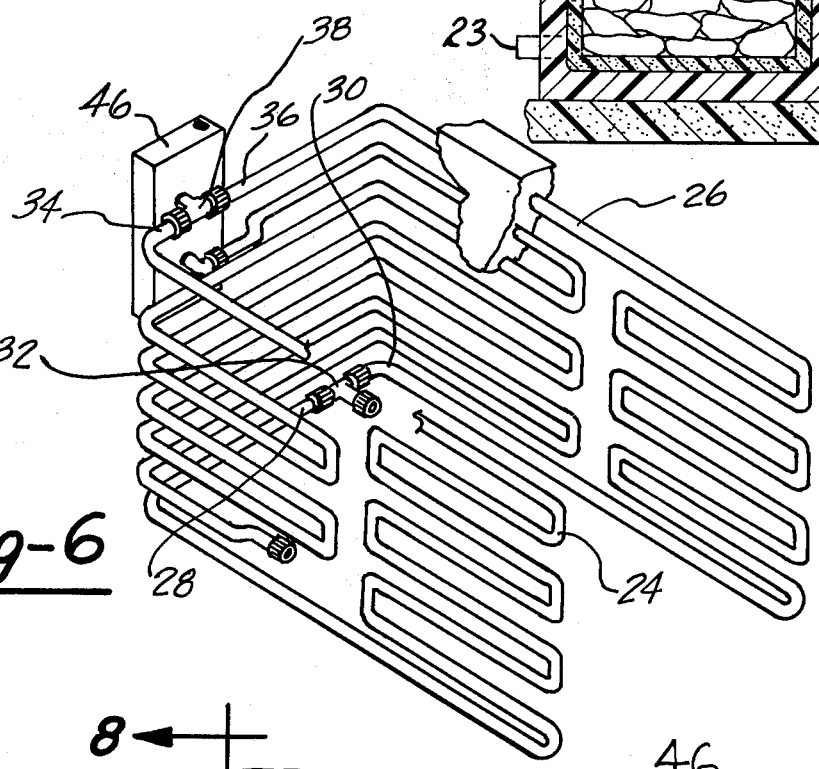
FIG. 6 is a perspective view of the cooler and freezer coils of the preferred embodiment of my invention.
Figure 7:
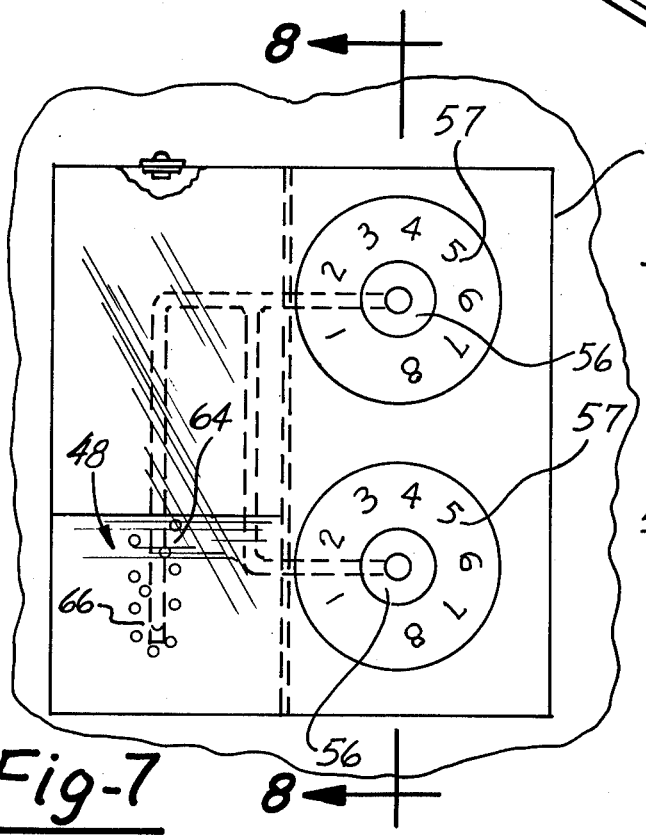
FIG. 7 is a detailed elevation view of the exterior controls for the cooler of the preferred embodiment.
Figure 8:
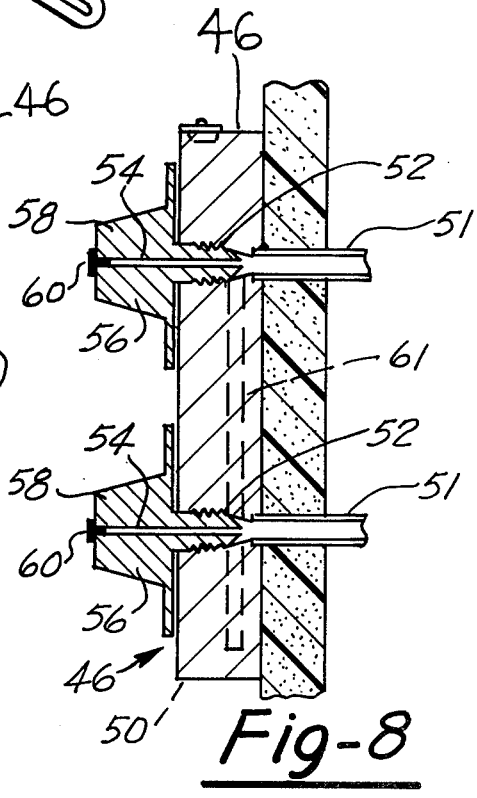
FIG. 8 is a sectional view through the manual flow control valves, taken along line 8—8 of FIG. 7.

A freezer compartment 80 is also formed within the walls of the cooler 10. The freezer compartment has a top 82 that may be removed to gain access to the freezer. The top 82 rests on a three-sided ledge 83 formed on the interior side and end walls of the cooler midway up from the base. As is best seen in FIG. 3, a serpentine coil 84 is built into the wall of the cooler. The input end of the freezer coil 84 is connected to the outlet in the freezer section 22 of the dry ice container 16 by a flexible conduit 86.

The output end of the freezer coil 84 is connected to a conduit 88 which extends though the end wall of the box and connects to the valve 46 exteriorly of the box.

Both the dry ice chest 16 and the freezer compartment 80 have a height approximately equal to half the interior depth of the cooler 10 so that articles to be refrigerated may be stored on the top of each chamber in the container.

The valve 46 includes a hollow rectangular body 50 connected to the output connector 38 through a central passage 51. Two identical valve sections are contained on the valve 46 and their common parts are identified by the same numerals. Only one will be described. A flanged coupling 52 with an internal thread extends partially across the width of the body 50 and a threaded valve stem 54 is screwed within the threaded section 52. A handle 56 is affixed to the outer end of the stem 54 allowing adjustment of the stem within the valve body and control of the aperture through which the gas flows from the input end 51. Suitable indicia 57 formed about the exterior 57 formed about the exterior of the valve body 50 allow repeatable adjustment of the handle.

A central aperture 58 is formed through the valve stem 54 and is closed off by a rubber blow-out plug 60. The plug 60 is press-fitted within the central aperture 58 and allows for the safe escape of excessive pressures built up within the coils 24 and 26 and the dry ice container 16. After blow-out, the plug may be manually reinserted within the aperture. Rotation of the handle 56 ajdusts the position of the end of the stem 54 relative to the input 51 and thus controls the aperture through which gases pass from the passage 51 into the valve body 50.

The valve body 50 has an exhaust passage 61 that connects both valve sections to the visual indicator 48. The indicator 48 contains a volume of liquid 64 visible through a window 66. Gas passing through the valve 46 bubbles up through the liquid 64 contained within the indicator and these bubbles may be observed through window 66. This provides a visual indication of the flow rate of flow of gas from the coils.

In normal use the valve section connected to the freezer coils is fully opened, allowing free flow of gases through the freezer coil and to the atmosphere through the visual indicator 48. At warm atmospheric temperatures, i.e., 80° to 85° F., the temperature within the freezer will normally be between about 10° F. and 20° F. The temperature in the lower part of the cooler may be about 35° F. and in the top about 40° to 45° F., except directly over the freezer, where the temperature will be lower. The temperature within the cooler section may be controlled by rotation of the appropriate handle 56 of the valve 46. In order to adjust the temperature within the cooler section, in a relative fashion, either raising or lowering it with respect to its existing temperature, the freezer valve section is first closed. The flow through the visual indicator then represents only gases passing through the cooler coils 24 and 26. To lower the temperature in the cooler section the handle 56 is rotated to open the valve 46. The degree to which the valve is opened may be determined by the rate of bubble flow through the visual indicator 48. The temperature within the cooler section is raised by closing the valve 46 in a similar fashion. After the flow through the cooling coil has been adjusted the freezer valve section may be reopened, allowing free flow of gas through the freezer coil 84.

Since the dry ice chamber 16 is positioned midway between the end walls of the cooler, with its side walls in proximity to the cooling coils 24 or 26, there is a high degree of insulation between the dry ice chamber and the surrounding atmosphere and any temperature losses from the dry ice chamber tend to lower the temperature of the freezer and/or cooler. The freezer section 80 is similarly disposed within the cooler so that it only loses temperature to the cooler, rather than directly to the atmosphere. The dry ice container is turned directly to the freezer section without insulation, thereby giving great cooling capacity.

The embodiments of the invention in which an exclusive property or privilege is claimed are defined as follows:

1. A sublimation refrigerator, comprising: an insulated outer container including a cover movable between an open position and a closed position; an inner container for a sublimating solid adapted to be disposed within the outer container, the inner container having a removable cover; a freezer compartment supported within the outer container and having a movable cover; a first elongated cooling coil extending along the interior side walls of the outer container and having one of its ends connected to the interior of the container for the sublimating solid; a second elongated cooling coil disposed within said freezer compartment and having its input ends connected to the interior of the container for the sublimating solid and its output end vented to the atmosphere; and manually adjustable restricting valve means connecting the output end of the first coil to the exterior of the outer container whereby a sublimating solid may be disposed within the inner container, the valve adjusted so as to control the relative flow of gas generated by sublimation of the solid through said first and second coils, and the temperature within the freezer compartment may be maintained at a lower value than the temperature within the outer container exteriorly of the freezer compartment.

2. The sublimation refrigerator of claim 1 including visual indicator means connected between the valve means and the atmosphere to provide a visual indication of the gas flow through the first elongated coil.

3. The sublimation refrigerator of claim 2 including means connecting the output end of the second coil to the atmosphere through said indicating means.

4. The sublimation refrigerator of claim 3 including a manually adjustable cut-off valve connected between the output end of the second elongated coil and said visual indicating means, whereby flow of gas from the second coil through the visual indicating means may be terminated to allow visual observation of the flow of gas through the first coil alone.

5. The sublimation refrigerator of claim 1 in which said first coil consists of two sections supported on opposite sides of the interior of the outer container, the two sections being connected in parallel.

6. The sublimation refrigerator of claim 2 in which said visual indicator means comprises a body of fluid having a transparent window and a connection at its lower end to the output ends of the elongated coils so that gas passing through the coils bubbles through the liquid, past the window.

7. A combination sublimation cooler and freezer, comprising: an outer insulated container; partition means disposed within the container to divide the container into a receptacle for a sublimating solid, a freezer compartment, and a cooler compartment; a first elongated cooling coil supported within the cooler compartment and having one of its ends connected to the interior of the compartment for the sublimating solid; a manually adjustable throttle valve means connected to the other end of the first cooling coil and to the atmosphere surrounding the exterior of the insulated container; a second elongated cooling coil supported within said freezer compartment and having one of its ends connected to the interior of the compartment for the sublimating solid and the other of its ends vented in a substantially unrestricted manner to the atmosphere, whereby regulation of the manually adjustable valve controls the relative resistance of the first and second coils to the passage of gases and accordingly the relative temperatures of the freezer and cooler compartments.

8. The sublimation refrigerator of claim 7 including visual indicator means connected between the manually adjustable throttle valve and the atmosphere exterior of the insulated container so that the flow of gas through the first elongated cooling coil may be adjusted by manipulation of the throttle valve.

9. The sublimation refrigerator of claim 8 including a manually adjustable cut-off valve connected to the end of the second elongated coil and to the input of the visual indicator means, allowing selective connection of the output of the second coil through the indicator means.

10. The sublimation refrigerator of claim 7 wherein said partition means includes a door for the freezer compartment, movable between an opened and a closed position.

11. The sublimation refrigerator of claim 10 wherein said partitions are removable from the outer insulated container, allowing use of the outer insulated container as a conventional cooler.

12. The sublimation refrigerator of claim 7 wherein the outer insulated container has a rectangular configuration and the partition is disposed within the container so that the resultant receptacle for sublimating solid is disposed centrally within the container, spaced from each end wall thereof.

* * * * *